US006418084B2

(12) United States Patent
Saito et al.

(10) Patent No.: US 6,418,084 B2
(45) Date of Patent: Jul. 9, 2002

(54) ULTRASONIC PROBE AND METHOD OF MANUFACTURING THE SAME

(75) Inventors: Koetsu Saito, Tokyo; Hirokazu Fukase, Kanagawa, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/782,862

(22) Filed: Feb. 14, 2001

(30) Foreign Application Priority Data

Jul. 13, 2000 (JP) ..... 2000-212453

(51) Int. Cl.[7] ..... H04R 1/00
(52) U.S. Cl. ..... 367/152; 367/150; 367/7
(58) Field of Search ..... 367/150, 152, 367/7; 310/335, 328; 73/642, 644; 600/459, 472; 181/176, 180

(56) References Cited

U.S. PATENT DOCUMENTS 4,651,850 A 3/1987 Matsuo
4,901,729 A * 2/1990 Saitoh et al. ..... 600/459
5,562,096 A 10/1996 Hossack et al.
5,626,138 A 5/1997 Hossack et al.

FOREIGN PATENT DOCUMENTS

JP 62-90139 4/1987
JP 5-34011 5/1993

* cited by examiner

*Primary Examiner*—Daniel T. Pihulic
(74) *Attorney, Agent, or Firm*—Merchant & Gould PC

(57) ABSTRACT

An ultrasonic probe includes a piezoelectric element for transmitting and receiving ultrasonic waves and an acoustic lens provided on an ultrasonic transmission/reception side of the piezoelectric element. The acoustic lens is formed in an acoustic lens shape by vulcanization formation through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups. Thus, the ultrasonic transmission and reception sensitivity is improved and the degradation in frequency characteristics is diminished. Consequently, higher resolution of an ultrasonic image and higher sensitivity can be achieved.

20 Claims, 4 Drawing Sheets

Relationships between Additive Rate of Silica ($SiO_2$) Particles and Acoustic Impedance, and Attenuation Relationship between Attenuation and Frequency of Acoustic Lens

ULTRASONIC PROBE AND METHOD OF MANUFACTURING THE SAME

BACKGROUND OF THE INVENTION

1. Field of the Invention

The present invention relates generally to an ultrasonic probe used in an underwater ultrasonic sensor, ultrasonic diagnostic equipment, or the like.

2. Related Background Art

An ultrasonic probe is used in a fish finder, ultrasonic diagnostic equipment for living bodies, and the like. In such an ultrasonic probe, an acoustic lens is used for converging a ultrasonic beam to improve resolution. A conventional acoustic lens material is described in JP 62( 1987)-90139 A. Preferably, an acoustic lens used in an ultrasonic probe for ultrasonic diagnostic equipment, particularly for living bodies, is formed in a convex shape so that close contact with a living body is achieved. Therefore, the acoustic lens is required to have a lower acoustic velocity than that (about 1.54 km/s) of a living body. Furthermore, in order to minimize the reflection of ultrasonic waves between the acoustic lens and a living body, it is necessary for the acoustic lens to have an acoustic impedance close to that (about 1.54 Mrayl) of the living body. Conventionally, as a material for the acoustic lens, one containing silicone rubber as the main material to which powder of titanium oxide, alumina, or the like is added has been used (JP 5( 1993)-34011 B).

The silicone rubber to which titanium oxide, alumina or the like is added, which has been used conventionally, has an acoustic impedance of about 1.6 Mrayl, which substantially satisfies the required condition. In the silicone rubber, however, since the ultrasonic waves are attenuated considerably, there has been a problem of degradation in ultrasonic transmission and reception sensitivity.

SUMMARY OF THE INVENTION

The present invention is intended to solve the above-mentioned conventional problem. It is an object of the present invention to provide an ultrasonic probe whose performance such as, for example, sensitivity and frequency characteristics, is not degraded due to the use of an acoustic lens having an acoustic impedance close to that of water or a living body and a low attenuation level.

In order to achieve the above-mentioned object, an ultrasonic probe according to the present invention includes a piezoelectric element for transmitting and receiving ultrasonic waves and an acoustic lens provided on an ultrasonic transmission/reception side of the piezoelectric element. The acoustic lens is formed by vulcanization through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

A method of manufacturing an ultrasonic probe of the present invention is directed to a method of manufacturing an ultrasonic probe including a piezoelectric element for transmitting and receiving ultrasonic waves and an acoustic lens provided on an ultrasonic transmission/reception side of the piezoelectric element. The method is characterized in that the acoustic lens is formed by at least one vulcanizing formation method selected from press molding and cast molding through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

An acoustic lens of the present invention is characterized by being formed in an acoustic lens shape by vulcanization formation through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

A method of manufacturing an acoustic lens according to the present invention is characterized in that the acoustic lens is formed by at least one vulcanizing formation method selected from press molding and cast molding through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

DETAILED DESCRIPTION OF THE INVENTION

Figure 1:
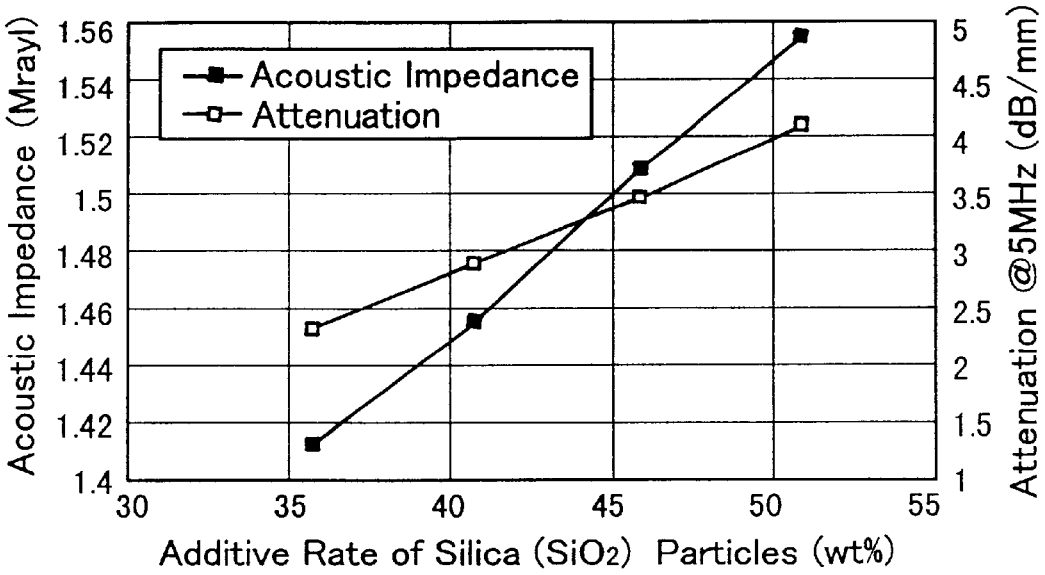
FIG. 1 is a graph showing acoustic impedance and attenuation of an acoustic lens for an ultrasonic probe according to a first embodiment of the present invention.

The ultrasonic probe of the present invention includes an acoustic lens formed of silicone rubber with a dimethylpolysiloxane structure including vinyl groups, to which silica (silicon oxide: $SiO_2$) particles in an amount of 40 wt % to 50 wt % are added as a reinforcer. This ultrasonic probe can improve ultrasonic transmission and reception sensitivity and can diminish degradation in frequency characteristics, thus obtaining an ultrasonic probe providing higher resolution of an ultrasonic image and higher sensitivity. In the above, it is preferable that the silica ($SiO_2$) particles have a weight-average particle size in the range between 15 nm and 30 nm.

When the acoustic lens provided in the ultrasonic probe is formed of a material prepared by addition of silica ($SiO_2$) particles in an amount of 40 wt % to 50 wt % to silicone rubber with a dimethylpolysiloxane structure including vinyl groups, an acoustic lens having characteristics including an acoustic impedance of 1.45 to 1.5 Mrayl and an attenuation of 2.9 to 4 dB/mm at a frequency of 5 MHz can be obtained. Hence, the ultrasonic transmission and reception sensitivity can be improved and the degradation in frequency characteristics can be diminished. In other words, an ultrasonic probe providing higher resolution of an ultrasonic image and higher sensitivity can be obtained.

In the ultrasonic probe, it is preferable that the acoustic lens has characteristics including an acoustic impedance of 1.45 to 1.5 Mrayl and an attenuation of 2.9 to 4 dB/mm at a frequency of 5 MHz.

It is further preferable that the acoustic lens has characteristics including an acoustic impedance of 1.46 Mrayl and an attenuation of 2.9 dB/mm at a frequency of 5 MHz.

It is further preferable that the acoustic lens is formed of a composition prepared by addition of silica ($SiO_2$) particles in an amount of 40 wt % to 45 wt % to silicone rubber with a dimethylpolysiloxane structure including vinyl groups.

In the above-mentioned method, it is preferable that the vulcanizing agent is 2,5-dimethyl-2,5-di-t-butyl peroxy hexane.

In the above-mentioned method, it is preferable that the conditions for the vulcanization include an addition of 0.1 to 1.0 wt % 2,5-dimethyl-2,5-di-t-butyl peroxy hexane as the vulcanizing agent and a treatment at a temperature in the range between 140° C. and 190° C. for 1 to 30 minutes.

In the method according to the present invention, it is preferable that the vulcanization formation is primary vulcanization formation. In this context, the "primary vulcanization formation" denotes formation by one-time heating vulcanization.

When the acoustic lens provided in the ultrasonic probe is formed of silicone rubber with a dimethylpolysiloxane structure including vinyl groups, to which silica ($SiO_2$) particles in an amount of 40.7 wt % are added and then a vulcanizing agent of 2,5-dimethyl-2,5-di-t-butyl peroxy hexane in an amount of 0.45 wt % is added thereto, which is vulcanized at a temperature of 170° C. for 10 minutes, the ultrasonic probe has improved ultrasonic transmission and reception sensitivity and diminished degradation in the frequency characteristics. Thus, an ultrasonic probe providing higher resolution of an ultrasonic image and higher sensitivity can be obtained.

When the acoustic lens provided in the ultrasonic probe is formed of silicone rubber with a dimethylpolysiloxane structure including vinyl groups, to which silica ($SiO_2$) particles in an amount of 40.7 wt % are added and then a vulcanizing agent of 2,5-dimethyl-2,5-di-t-butyl peroxy hexane in an amount of 0.45 wt % is added thereto, which thus is vulcanized at a temperature of 170° C., and the acoustic lens has characteristics including an acoustic impedance of 1.46 Mrayl and an attenuation of 2.9 dB/mm at a frequency of 5 MHz, the ultrasonic probe has improved ultrasonic transmission and reception sensitivity and diminished degradation in the frequency characteristics. Thus, an ultrasonic probe providing higher resolution of an ultrasonic image and higher sensitivity can be obtained.

In the above, it is preferable that the vinyl groups included in the dimethylpolysiloxane are present in the range between 0.1 and 2 mole %, more preferably, in the range between 0.5 and 1 mole %. The vinyl groups may be present either at or between the ends of the dimethylpolysiloxane molecule. Preferably, the vinyl groups are positioned at random.

As a method for molding the acoustic lens of the present invention, press molding or cast molding can be employed. In general, the press molding or cast molding is carried out during vulcanization.

According to the present invention, the acoustic lens provided in the ultrasonic probe is formed of a material prepared by addition of silica ($SiO_2$) particles in an amount of 40 wt % to 50 wt % to silicone rubber with a dimethylpolysiloxane structure including vinyl groups. In other words, the silica ($SiO_2$) particles are selected as an additive material and a specific range of an additive amount of 40 wt % to 50 wt % is selected, thus improving the ultrasonic transmission and reception sensitivity and diminishing the degradation in the frequency characteristics. Consequently, higher resolution of an ultrasonic image and higher sensitivity can be achieved.

Specific embodiments are described in detail with reference to the drawings as follows.

First Embodiment

Figure 2:
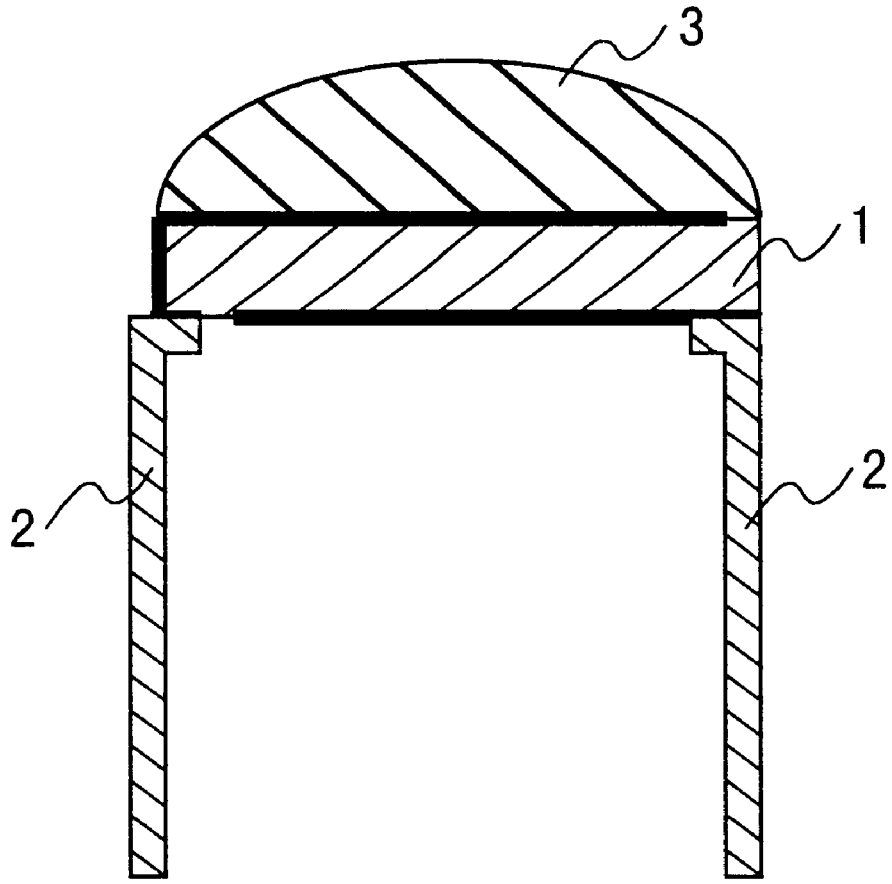
FIG. 2 is a schematic sectional view of the ultrasonic probe according to the first embodiment of the present invention.
Figure 3:
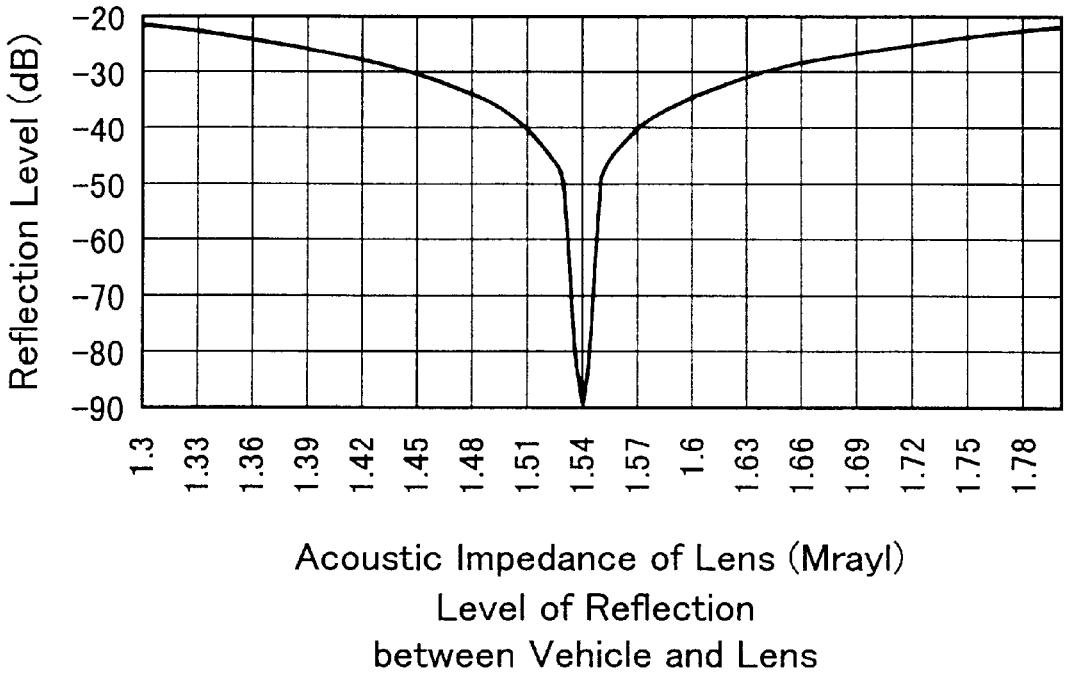
FIG. 3 is a graph showing a level of reflection between a vehicle and the acoustic lens for the ultrasonic probe according to the first embodiment of the present invention.

FIG. 1 is a graph showing attenuation (attenuation characteristics) and acoustic impedance of an acoustic lens used in an ultrasonic probe according to a first embodiment of the present invention. FIG. 2 is a schematic sectional view of the ultrasonic probe according to the first embodiment of the present invention. FIG. 3 is a graph showing the relationship of a reflection level of an ultrasonic wave according to the difference in acoustic impedance between water or a living body as a vehicle and an acoustic lens.

The first embodiment of the present invention is directed to an ultrasonic probe with an acoustic lens. The material of the acoustic lens is silicone rubber (with a weight-average molecular weight of $5\times10^5$) with a dimethylpolysiloxane structure including 0.6 mole % vinyl groups, to which silica ($SiO_2$) particles are added (with a weight-average particular size of 15 to 30 nm) in an amount of 40 wt % to 50 wt %. Since the acoustic impedance is close to that of water or a living body, the reflection level is low and the attenuation level also is low, thus obtaining an ultrasonic probe improving the ultrasonic transmission and reception sensitivity and securing excellent characteristics without damaging frequency characteristics.

In FIG. 2, the ultrasonic probe of the present embodiment includes a piezoelectric element 1 for transmitting and receiving ultrasonic waves, electric terminals 3, and an acoustic lens 3 with a convex shape. The piezoelectric element 1 is provided with electrodes at least on its both surfaces. For the piezoelectric element 1, PZT (lead-zirconate-titanate) based piezoelectric ceramic, single crystal, polymer such as PVDF (polyvinylidene fluoride) or the like is used. The electric terminals 2 are connected to the electrodes provided on both surfaces of the piezoelectric element 1. The acoustic lens 3 is provided on one surface of the piezoelectric element 1, on the side through which ultrasonic waves are transmitted to or received from a vehicle (e.g. water or a living body). It should be appreciated that a back load-bearing member may be provided for supporting the piezoelectric element 1, on the opposite side of the piezoelectric element 1 to that on which the acoustic lens 3 is provided, although it is not shown in FIG. 2. In addition, an acoustic matching layer may be provided between the piezoelectric element 1 and the acoustic lens 3 for efficient transmission and reception of ultrasonic waves. With respect to the dimension of the ultrasonic probe shown in FIG. 2, the piezoelectric element 1 has a thickness of about 0.28 mm and a width of about 12 mm, the electric terminals 2 have a thickness of about 0.08 mm and a length of about 20 mm, and the acoustic lens 3 has a circular-arc convex portion with a maximum height (a maximum thickness) of about 1.0 mm and with a radius (R) of the circular arc of about 26 mm.

In this ultrasonic probe, by applying electric signals from the main body of ultrasonic diagnostic equipment or the like via the electric terminals 2, the piezoelectric element 1 mechanically vibrates to transmit and receive ultrasonic waves. An ultrasonic probe for ultrasonic diagnostic equipment using water or a living body as a vehicle is a so-called sensor, which is used for diagnosis. While being in direct contact with a living body, the ultrasonic probe transmits ultrasonic waves to the living body and receives reflected waves from the living body. Then, the signals based on the reflected waves are processed in the main body and a diagnostic image is displayed on a monitor for diagnosis.

The desired performance of the ultrasonic probe includes a high sensitivity and wide-band frequency characteristics. Therefore, the characteristics desired for the acoustic lens 3 include the following three aspects. First, in order to converge ultrasonic waves, as is known conventionally, the acoustic lens 3 is required to have a different acoustic velocity from that of water or a living body as a vehicle. Particularly, it is required to use a material whose acoustic velocity is slower than that (about 1.54 km/s) of the vehicle (in this case, water or a living body) for forming the acoustic lens 3 in the convex shape on the vehicle side. Conventionally, general silicone rubber has been used as the material. Second, it is required to reduce the reflection caused by the difference in acoustic impedance between the acoustic lens 3 and the vehicle, and therefore, an acoustic impedance (about 1.54 Mrayl) close to that of the vehicle is required. Third, in order to prevent the decrease in ultrasonic transmission and reception sensitivity and the degradation in frequency characteristics due to the attenuation of the acoustic lens 3, the attenuation is required to be as small as possible. In view of the three desired characteristics described above, in the present embodiment, as the material of the acoustic lens 3 in which the characteristics are improved compared to those in a conventional one, particularly the characteristic with respect to the attenuation is improved considerably, silica ($SiO_2$) particles in an amount of 40 wt % to 50 wt % was added to silicone rubber with a dimethylpolysiloxane structure including vinyl groups and a 0.45 wt % vulcanizing agent of 2,5-dimethyl 2,5-di-t-butyl peroxy hexane was added thereto, which was vulcanized at a temperature of 170° C. for 10 minutes during the press molding to form the acoustic lens 3 (formation carried out simultaneously with vulcanization).

FIG. 1 is a graph showing attenuation at a frequency of 5 MHz and acoustic impedance of an acoustic lens formed of the material prepared by mixing silica powder (with a weight-average particle size of 20 nm) in an amount of 35.07 to 50.07 wt % to silicone rubber with a dimethylpolysiloxane structure including vinyl groups and vulcanizing it by press molding. In the graph, the horizontal axis indicates an added amount (weight ratio) of silica (silicon oxide). As is apparent from FIG. 1, the acoustic impedance increases with the increase in added amount of silica to approach the acoustic impedance of water or a living body of 1.54 Mrayl, while the attenuation tends to increase. In this case, the acoustic velocity is in a range of 1.02 to 1.05 km/s, which is slower than that of the vehicle. For instance, an acoustic lens formed of the material prepared by addition of silica in an amount of 40.7 wt % to the silicone rubber and vulcanizing has a acoustic velocity of 1.025 km/s, an acoustic impedance of 1.46 Mrayl and an attenuation of 2.9 dB/mm at 5 MHz.

FIG. 3 is a graph showing the changes in reflection level and acoustic impedance of the acoustic lens 3 with respect to the acoustic impedance of water or a living body of 1.54 Mrayl. The values in FIG. 3 are calculated using the following formula.

$$\text{Reflection Level } R(\text{dB})=20\times\log[(Zl-Zm)/(Zl+Zm)]$$

In the formula, Zl denotes the acoustic impedance of the acoustic lens 3, and Zm indicates the acoustic impedance of a vehicle (water or a living body) of 1.54 Mrayl. As can be seen from FIG. 3, the reflection level decreases as the acoustic impedance of the acoustic lens approaches 1.54 Mrayl, the acoustic impedance of the vehicle.

The following description is directed to the level, at which no problem is caused, of the difference in acoustic impedance between the vehicle and the acoustic lens 3. For example, in the case of image diagnosis using ultrasonic diagnostic equipment, the dynamic range of the equipment itself is about 60 dB without consideration to noise components. In other words, it can be said that no problem is caused in this level or in a level lower than about 60 dB, since the difference is covered with noise components of the equipment. As the reflection level shown in FIG. 3, values with respect to only one direction, i.e. the case of transmission alone are indicated. In actual image display, transmitted ultrasonic waves are reflected from the vehicle, which then are received as return signals, i.e. the signals go through the acoustic lens twice by being transmitted and received. Therefore, an acceptable reflection level may be twice the reflection level shown in FIG. 3.

Consequently, as an acceptable reflection level causing no problem in ultrasonic image, it is required to be −30 dB or lower. Viewed from FIG. 3, the acoustic impedance at a reflection level of −30 dB or lower is in the range between 1.45 and 1.64 Mrayl. This range of the acoustic impedance corresponds to the range of an additive rate of 40 wt % or higher of the silica particles added to the silicone rubber with a dimethylpolysiloxane structure including vinyl groups in the graph shown in FIG. 1. However, this is the case where attention is paid only to the acoustic impedance and the attenuation as an important characteristic is disregarded, and therefore does not provide a sufficient evaluation. Then, when an evaluation is made with additional consideration to small attenuation, it can be said that preferably, the added amount of silica particles is in a range close to 40 wt % when viewed from FIG. 1. The attenuation of a conventional acoustic lens is at least about 4.45 dB/mm at a frequency of 5 MHz (about 2.18 dB/mm at 3.5 MHz). Therefore, in view of the fact that the attenuation at least smaller than that provides improvement, the attenuation exerting a higher effect than that obtained conventionally can be considered as being 4 dB/mm or lower.

From such backgrounds as described above, the present acoustic lens can be improved considerably in sensitivity and frequency characteristics compared to the conventional acoustic lens by limiting the acoustic impedance to be in the range of 1.45 to 1.64 Mrayl and the attenuation to be 4 dB/mm or lower at a frequency of 5 MHz. Therefore, the weight ratio of silica particles added to the silicone rubber with a dimethylpolysiloxane structure including vinyl groups according to the present embodiment can be selected from the range between 40 wt % and 50 wt %. In increasing frequency ranges, the difference between the case of the present invention and the conventional case is increased and the acoustic lens 3 of the present embodiment exhibits a further considerable effect.

This embodiment of the ultrasonic probe described above was not defined as a single type or an array type with a plurality of piezoelectric elements 1 being arranged. However, it should be appreciated that the acoustic lens of the present embodiment can be applied to all the types.

As described above, the acoustic lens used in the ultrasonic probe according to the first embodiment of the present invention allows the ultrasonic transmission and reception sensitivity to be improved and the degradation in frequency characteristics to be diminished. Therefore, an ultrasonic probe providing higher resolution of an ultrasonic image and higher sensitivity can be obtained.

Second Embodiment

In the second embodiment of the present invention, an acoustic lens was formed of the same silicone rubber with a dimethylpolysiloxane structure including vinyl groups as that used for the acoustic lens 3 provided in the ultrasonic probe according to the first embodiment shown in FIG. 2 and is formed by addition of silica ($SiO_2$) particles in an amount of 40.7 wt % to the silicone rubber and a vulcanizing agent of 2,5-dimethyl-2,5-di-t-butyl peroxy hexane in an amount of 0.45 wt % was added thereto, which thus was vulcanized during press molding at a temperature of 170° C. for 10 minutes (formation carried out simultaneously with vulcanization). The vulcanizing agent can be selected depending on the processability, molding conditions, physical properties after the molding, or the like. Generally, when the silicone rubber is to be vulcanized, the vulcanization is conducted twice, i.e. in two stages of so-called primary vulcanization and secondary vulcanization. However, the silicone rubber in the present embodiment does not require the secondary vulcanization and therefore can be formed by one-time heating vulcanization. The present inventors have conducted various studies and as a result, found that the attenuation was smaller when using silicone rubber requiring no secondary vulcanization compared to the attenuation when using the silicone rubber obtained after the secondary vulcanization.

Figure 4:
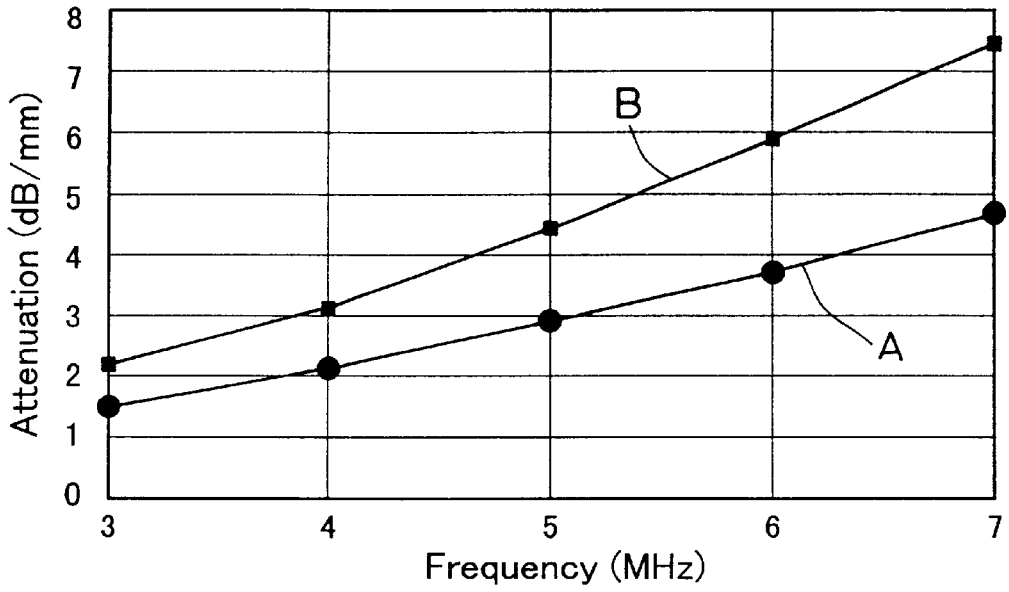
FIG. 4 is a graph showing attenuation and a frequency of an acoustic lens for an ultrasonic probe according to a second embodiment of the present invention.

The acoustic lens 3 formed by vulcanization of the above-mentioned material has a acoustic velocity of 1.025 km/s and an acoustic impedance of 1.46 Mrayl. FIG. 4 is a graph illustrating the relationship between frequency and attenuation. The relationship between frequency and attenuation with respect to the acoustic lens material of the present embodiment is indicated with A in the graph shown in FIG. 4. For comparison, as characteristics of a conventional acoustic lens of silicone rubber, which has been considered to have small attenuation, the relationship between frequency and attenuation is indicated with B. From FIG. 4, it is clear that the attenuation of the acoustic lens of the present embodiment indicated with A is smaller than that in the conventional one. For instance, when the comparison is made at a frequency of 5 MHz, while the attenuation is 4.45 dB/mm in the conventional acoustic lens, the attenuation is 2.9 dB/mm in the present embodiment, which is smaller by about 1.35 dB/mm. When the comparison is made at a high frequency of 7 MHz, while the attenuation is 7.47 dB/mm in the conventional acoustic lens, the attenuation is 4.68 dB/mm in the present embodiment, which is smaller by about 2.79 dB/mm. In this case, the difference in the attenuation becomes increasingly conspicuous. Consequently, it can be understood easily that in the ultrasonic probe with the acoustic lens formed using the material according to the present embodiment, the sensitivity can be improved considerably. It also can be understood easily that the problem of lowering the sensitivity by the attenuation of high frequency components due to the attenuation of the acoustic lens can be improved by using the acoustic lens according to the present embodiment.

As described above, the acoustic lens used in the ultrasonic probe according to the second embodiment of the present invention can improve the ultrasonic transmission and reception sensitivity and also can diminish the degradation in frequency characteristics. Therefore, an ultrasonic probe providing higher resolution of an ultrasonic image and higher sensitivity can be obtained.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An ultrasonic probe, comprising:

a piezoelectric element for transmitting and receiving ultrasonic waves; and an acoustic lens provided on an ultrasonic transmission/reception side of the piezoelectric element, wherein the acoustic lens is formed by vulcanization formation through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

2. The ultrasonic probe according to claim 1, wherein the vulcanization formation is primary vulcanization formation.

3. The ultrasonic probe according to claim 1, wherein the acoustic lens has characteristics including an acoustic impedance of 1.45 to 1.5 Mrayl and an attenuation of 2.9 to 4 dB/mm at a frequency of 5 MHz.

4. The ultrasonic probe according to claim 3, wherein the acoustic lens has characteristics including an acoustic impedance of 1.46 Mrayl and an attenuation of 2.9 dB/mm at a frequency of 5 MHz.

5. The ultrasonic probe according to claim 1, wherein the added amount of the silica ($SiO_2$) particles is in a range between 40 wt % and 45 wt %.

6. The ultrasonic probe according to claim 1, wherein 2,5-dimethyl-2,5-di-t-butyl peroxy hexane is added in an amount in a range between 0.1 and 1.0 wt %.

7. The ultrasonic probe according to claim 1, wherein the vinyl groups included in the dimethylpolysiloxane structure are present in a range between 0.1 and 2 mole %.

8. The ultrasonic probe according to claim 7, wherein the vinyl groups included in the dimethylpolysiloxane structure are present in a range between 0.5 and 1 mole %.

9. The ultrasonic probe according to claim 1, wherein the acoustic lens is formed by press molding or cast molding.

10. The ultrasonic probe according to claim 1, wherein the silica ($SiO_2$) particles have a weight-average particle size in a range between 15 and 30 nm.

11. A method of manufacturing an ultrasonic probe including a piezoelectric element for transmitting and receiving ultrasonic waves and an acoustic lens provided on an ultrasonic transmission/reception side of the piezoelectric element, wherein the acoustic lens is formed by at least one vulcanizing formation method selected from press molding and cast molding through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

12. The method of manufacturing an ultrasonic probe according to claim 11, wherein the vulcanizing formation method is primary vulcanizing formation.

13. The method of manufacturing an ultrasonic probe according to claim 11, wherein the 2,5-dimethyl-2,5-di-t-butyl peroxy hexane is added in an amount in a range between 0.1 wt % and 1.0 wt %.

14. The method of manufacturing an ultrasonic probe according to claim 11, wherein the vulcanization is carried out under conditions including heating at a temperature in a range between 140 and 190° C. for 1 to 30 minutes.

15. The method of manufacturing an ultrasonic probe according to claim 11, wherein the silica ($SiO_2$) particles are added in an amount in a range between 40 wt % and 45 wt %.

16. The method of manufacturing an ultrasonic probe according to claim 11, wherein the vinyl groups included in the dimethylpolysiloxane structure are present in a range between 0.1 and 2 mole %.

17. The method of manufacturing an ultrasonic probe according to claim 16, wherein the vinyl groups included in the dimethylpolysiloxane structure are present in a range between 0.5 and 1 mole %.

18. The method of manufacturing an ultrasonic probe according to claim 11, wherein the silica ($SiO_2$) particles have a weight-average particle size in a range between 15 and 30 nm.

19. An acoustic lens, formed in an acoustic lens shape by vulcanization formation through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

20. A method of manufacturing an acoustic lens, wherein an acoustic lens is formed by at least one vulcanizing formation method selected from press molding and cast molding through addition of 2,5-dimethyl-2,5-di-t-butyl peroxy hexane as a vulcanizing agent to a composition prepared by addition of silica ($SiO_2$) particles in an amount of 40 wt % to 50 wt % to silicone rubber with a dimethylpolysiloxane structure including vinyl groups.

* * * * *